US007021035B2

(12) United States Patent
Muri et al.

(10) Patent No.: US 7,021,035 B2
(45) Date of Patent: Apr. 4, 2006

(54) APPARATUS FOR PRODUCING STACK BUNDLES

(75) Inventors: Ivan Muri, Schötz (CH); Markus Jegge, Oberentfelden (CH)

(73) Assignee: Müller Martini Holding AG, Hergiswil (CH)

( * ) Notice: Subject to any disclaimer, the term of this patent is extended or adjusted under 35 U.S.C. 154(b) by 0 days.

(21) Appl. No.: 10/676,043

(22) Filed: Oct. 2, 2003

(65) Prior Publication Data

US 2004/0065214 A1 Apr. 8, 2004

(30) Foreign Application Priority Data

Oct. 2, 2002 (EP) ..... 02405851

(51) Int. Cl.
*B65B 35/30* (2006.01)

(52) U.S. Cl. ..... 53/542; 53/531; 53/447; 53/48

(58) Field of Classification Search ..... 53/447, 53/448, 531, 542; 271/181; 100/7
See application file for complete search history.

(56) References Cited

U.S. PATENT DOCUMENTS 4,641,489 A * 2/1987 Wood ..... 53/529
4,723,883 A * 2/1988 Smith ..... 100/7
4,772,003 A 9/1988 Nobuta et al.
4,824,093 A * 4/1989 Belden ..... 271/216
5,358,232 A * 10/1994 Arendes et al. ..... 271/181
5,393,196 A 2/1995 Bluemle
5,515,667 A * 5/1996 Roosli ..... 53/542
6,003,860 A * 12/1999 von Aesch et al. ..... 271/214
6,782,678 B1 * 8/2004 Bodereau ..... 53/542

FOREIGN PATENT DOCUMENTS

| | | |
|---|---|---|
| EP | 0623542 A1 | 5/1994 |
| EP | 0741101 A2 | 5/1996 |
| FR | 2777876 A1 | 10/1999 |
| JP | 57112266 | 7/1982 |
| JP | 04032459 | 2/1992 |
| JP | 06219622 | 8/1994 |

* cited by examiner

*Primary Examiner*—Louis Huynh
(74) *Attorney, Agent, or Firm*—Venable LLP; Robert Kinberg; Steven J. Schwarz

(57) ABSTRACT

An arrangement for producing stack bundles from signatures includes a horizontal stack deposit support, a conveyor to supply a flow of signatures to the stack deposit support for formation of a signature stack having a front end and a back end, and a supporting device adapted to form a stack bundle having a front end and a back end. The supporting device comprises a first support element adapted to rise from below the stack deposit support and act on the front end of the stack, a second support element adapted to rise from below the stack deposit support and act on the back end of the stack bundle, and a third support element arranged to rise from below the stack deposit support in a first location to act on the front end of the stack and in a second location to act on the front end of the stack bundle.

19 Claims, 8 Drawing Sheets

APPARATUS FOR PRODUCING STACK BUNDLES

CROSS-REFERENCE TO RELATED APPLICATION

This application claims the priority of European Patent Application with Serial No 02405851.3-1256, filed on Oct. 2, 2002, the subject matter of which is incorporated herein by reference.

BACKGROUND OF THE INVENTION

In stack bundling machines, the discharge area of a printing press for signatures may discharge signatures in a scaled flow and be connected to arrangements for taking over the discharged signatures to accumulate and shape them into configurations suitable for storage. For example, the discharged signatures may be shaped as bundles for further processing into various printed products such as magazines, newspapers, brochures, and any other printed products containing the signature bundles. EP 0 623 542 A1 describes examples of stack bundling machines such as the stack bundling machine marketed by Muller Martini Holding AG under the commercial name "AVANTI."

However, processing steps in stack bundling machines, e.g., removing the products from a printing machine and preparing them for further processing by shaping them as bundles, are time-consuming and often unreliable. Thus, it is desirable to develop a high capacity stack bundling machines that operate reliably and have shorter cycle times, more selection options with respect to the bundle length and shorter residual bundles.

SUMMARY OF THE INVENTION

It is the object of the invention to create an arrangement with which the above described goals can be achieved.

The above and other objects are achieved by an arrangement for producing stack bundles from signatures, comprising a horizontally extending stack deposit support, a conveyor to continuously supply a scaled flow of the signatures to the stack deposit support for formation of a signature stack, a multi-part supporting device comprising first, second and third support elements, a compressing machine, and a bundle strapping machine. The supporting device is arranged to form a stack bundle by engaging the stack from below, and the stack bundle has a front end and a back end with respect to a direction of a movement of the stack bundle through the arrangement. The first and second support elements are arranged to act on the front end and the back end of the stack bundle, respectively, and arranged to be raised from below the stack deposit support to above the stack deposit support. The third support element is arranged to be raised and act on the front end of the stack bundle. The supporting device is arranged to transfer the stack bundle to the compressing machine by moving the stack bundle from a waiting position to a transfer position along the stack deposit support. The compressing machine is arranged to transfer the stack bundle to the bundle strapping machine.

The third support element can be controlled to move independently of the first and second support elements along the stack deposit support. By having the third support element with its independent mobility, a higher production can be achieved in the arrangement.

A separating device assigned to the first and second support element can be used to form a separating gap between the signatures supplied in a scaled flow by raising the first and second support elements into the separating gap simultaneously. Thus, the separating device separates two otherwise adjacent signatures for insertion of the first and second support elements in-between.

A bundle strapping machine can be operationally connected to the stack deposit support for strapping the stack bundles with at least one band extending in the direction of the movement of the stack bundle through the arrangement. The compressing machine can transport the stack bundle held between the compressing component and the spaced-apart compressing component to the strapping machine. By using the compressing machine and/or by compressing the bundles before the strapping operations of the bundle strapping machine, a saving in cycle times can occur within the arrangement.

A guide extending parallel to the stack deposit support can be used for moving the support elements of the supporting device along the stack deposit support. The guide can have a simple design.

An end-plate feeding mechanism can be arranged on the stack deposit support to reinforce the ends of the stack bundle with end plates. With the stack bundle being in the transfer position, a back end plate assigned for the back end of a stack bundle can be supplied at a gap between the second support element resting against the back end of the stack bundle and the spaced-apart compressing component assigned to the back end of the stack bundle. Thus, a reliable end-plate positioning on the stack deposit support is ensured.

A front end plate assigned to the front end of a stack bundle can be transported in a direction opposite to the movement direction of the stack bundle through the arrangement by being carried inside a space formed between the second and third support elements on the stack deposit support.

With the stack bundle being in the transfer position, the end plate-feeding mechanism can be arranged between the compressing components of the compressing machine, thus making it possible to produce stack bundles of any desired length. In an exemplary design of the compressing machine, rails extend above the stack deposit support and parallel thereto so that the compressing machine can move back and forth along the rails.

BRIEF DESCRIPTION OF THE DRAWINGS

The foregoing description of the invention will be apparent from the following, more particular description of embodiments of the invention, as illustrated in the accompanying drawings, wherein like reference numbers generally indicate identical, functionally similar, and/or structurally similar elements.

DETAILED DESCRIPTION OF THE INVENTION

Figure 1A:
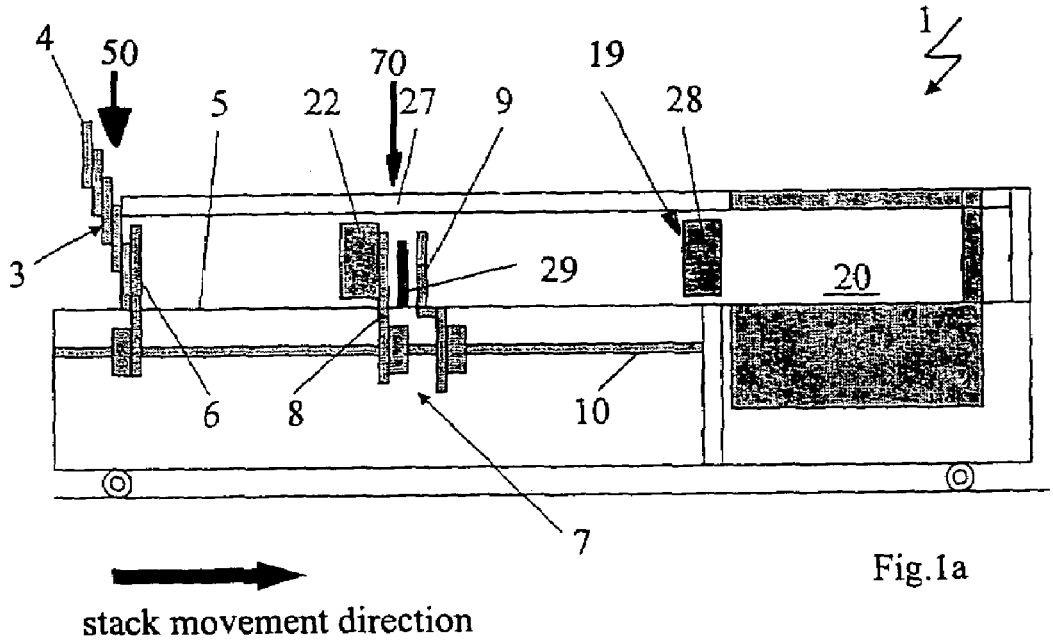
FIG. 1*a* is a schematic representation of an arrangement according to the invention at the start of producing stack bundles of signatures.

FIGS. 1*a* to 1*l* depict an arrangement 1 for producing stack bundles 2 by continuously supplying signatures 4 in a scaled flow 3 from a conveyor as represented by an arrow 50. The conveyor 50 can supply vertically aligned (i.e., upright) signatures 4 to a horizontal stack deposit support 5 after arranging the signatures 4 in a desired scaled formation. Such operations are described in EP 0 623 542 A1, the subject matter of which is incorporated herein by reference in its entirety. Following the printing press, the scaled formation should be laterally turned by 180°.

If the scaled formation is to be processed by a roller, a rewinding to another roller is unavoidable. FIGS. 1*a* to 1*l* show that the arrangement 1 can be designed to have wheels for being transportable and, thus, connectable to the discharge areas of different printing presses within a plant.

In FIG. 1*a*, the arrangement 1 is shown in an empty state having an incoming, scaled flow 3 of signatures. A first support element 6 of a multi-part supporting device 7 is raised above the stack deposit support 5. A second support element 8 and a third support element 9 of the multi-part supporting device are also raised above the stack deposit support 5. Each of the support elements 6, 8, 9 of the multi-part supporting device 7 can be independently driven along the stack deposit support 5 with the aid of a guide 10, the guide 10 being arranged below and parallel to the stack deposit support 5. The movement of the support elements 6, 8, 9 along the stack deposit support 5 can be facilitated by using any known traction means such as toothed belts and chains driven along the stack deposit support 5 in a direction of a movement of the stack bundles through the arrangement. Controlled adjustment means such as traversing gears operated in conjunction with pneumatic cylinders can be used for raising and lowering the support elements 6, 8, 9 with respect to the stack deposit support. Compressing components 22 and 28 of a compressing machine 19 can be arranged above the stack deposit support 5 for gripping and transporting a stack bundle on the stack deposit support 5 to an adjacent strapping machine 20 by moving along the stack deposit support 5.

At the start of the stack formation, the second and third support elements 8, 9 of the multi-part supporting device 7 are moved to a position above the stack deposit support 5 and takes over an end plate 29 assigned to a front end of a respective stack bundle with respect to a direction of a movement of the stack bundles through the arrangement. The front end plate 29 can be taken from a plate magazine (represented by the arrow 70 in FIG. 1*a*) on the side of the arrangement 1 and deposited between the spaced-apart, second and third support elements 8, 9. The front end plate 29 between the second and third support elements 8, 9 is guided along the stack deposit support 5 to the front end of the stack of signatures held in an upright, vertical position by the first support element 6.

Figure 1B:
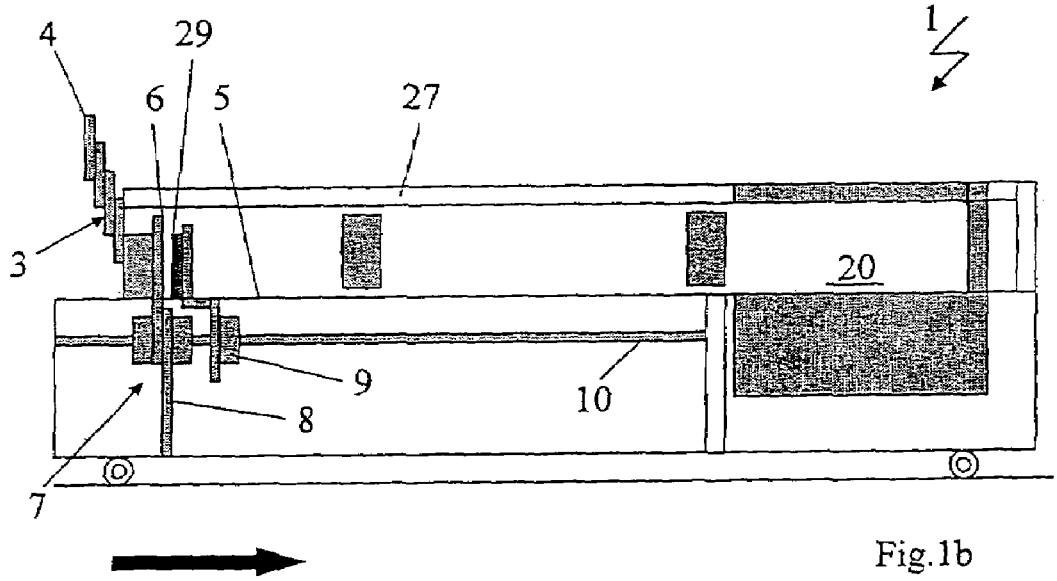
FIG. 1*b* is a schematic representation of the arrangement according to FIG. 1*a*, showing an end plate moved closer to a front end of a stack.

In FIG. 1*b*, the second support element 8 has moved away from the stack deposit support 5 in a downward direction and the front end plate 29 for reinforcing the front end of the stack is held between the first and third support elements 6 and 9. In this way, the stack formation against the first support element 6 is maintained.

Figure 1C:
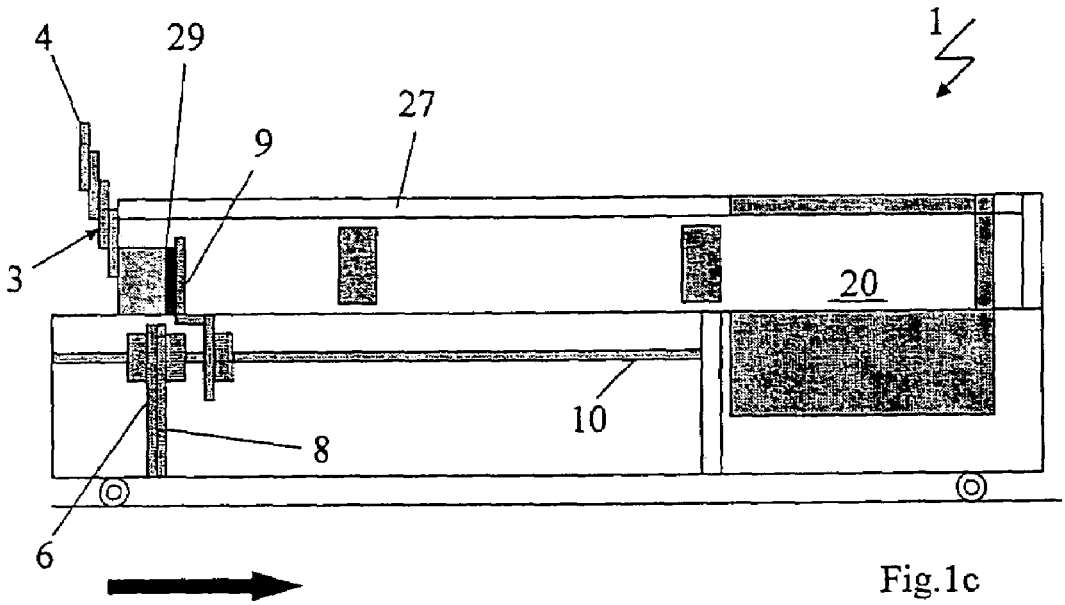
FIG. 1*c* is a schematic representation of the arrangement with an end plate resting against the front end of the stack.

In FIG. 1*c*, the first support element 6 of the multi-part supporting device 7 has moved downwardly so that the front end plate 29 supported by the third support element 9 comes to rest against the front end of the stack.

Figure 1D:
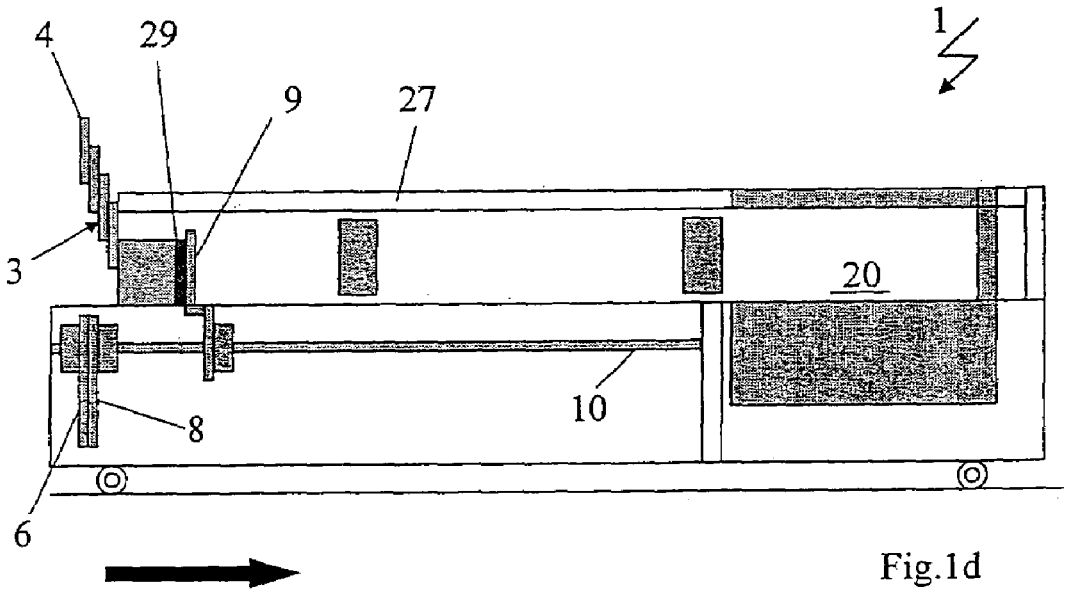
FIG. 1*d* is a schematic representation of the arrangement with an increasing stack length.

In FIG. 1*d*, while the stack on the stack deposit support 5 continues to grow, the first and second support elements 6, 8 move to their starting position in front of a back end of the stack with respect to the movement direction of the stack.

Figure 1E:
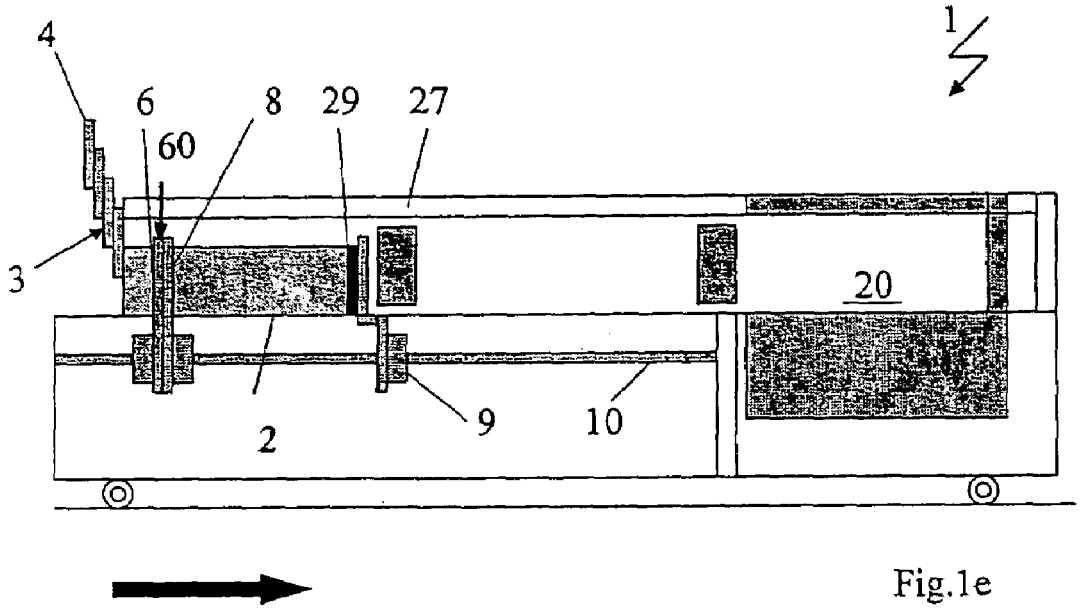
FIG. 1*e* is a schematic representation of the arrangement with support elements raised into a separation gap in the stack.

In FIG. 1*e*, a stack bundle 2 has formed between the front end plate 29, which is held in the upright standing position by the third support element 9, and the second support element 8, by moving and raising the first and second support elements 6 and 8 from their starting position to a separation position. In placing the first and second support elements 6 and 8 into the separating position, a separating device, which is represented by an arrow 60 and is well known, can be used. An exemplary embodiment of the separating device 60 is disclosed in EP 0 623 542 A1. In its operation, the separating device 60 can create a gap in the stack formation for inserting the first and second support elements 6, 8 jointly. By inserting the first and second support elements into the gap, the first support element 6 takes over the function of supporting the front end of the increasing stack and the second support element 8 supports the back end of the stack bundle 2.

Figure 1F:
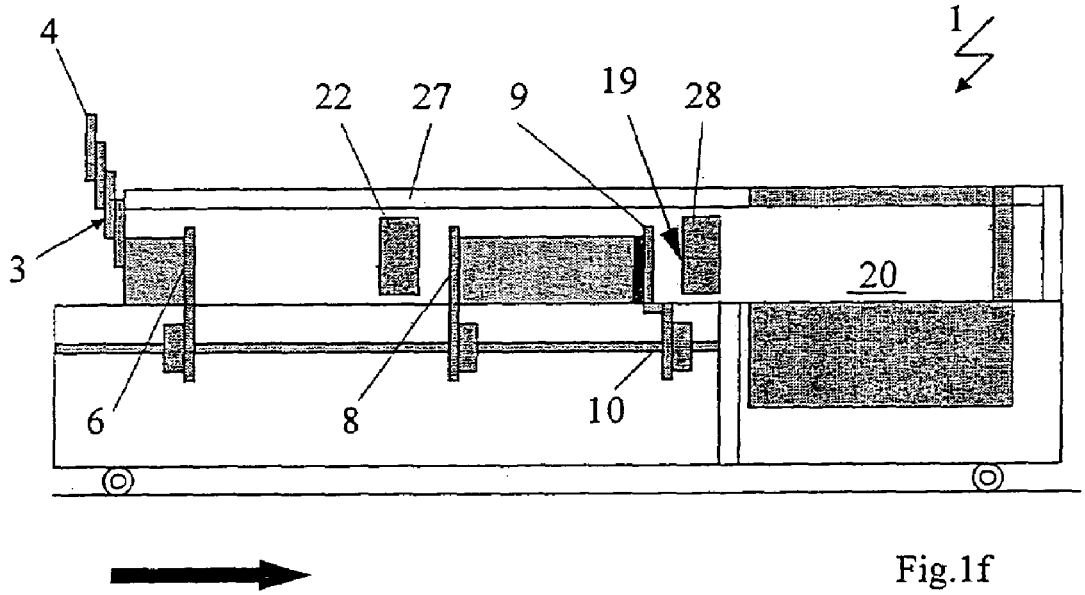
FIG. 1*f* is a schematic representation of the arrangement where a stack bundle is separated from the stack and is in a transfer position for being taken over by a compressing machine.

In FIG. 1*f*, with the length of the stack continuing to increase, the second and third support elements 8 and 9 have moved the stack bundle 2 from a waiting position to a transfer position of the stack bundle where it is to be taken over by the compressing components 22, 28 of the compressing machine 19. The waiting position of the stack bundle is any position where the stack bundle is not in the transfer position.

Figure 1G:
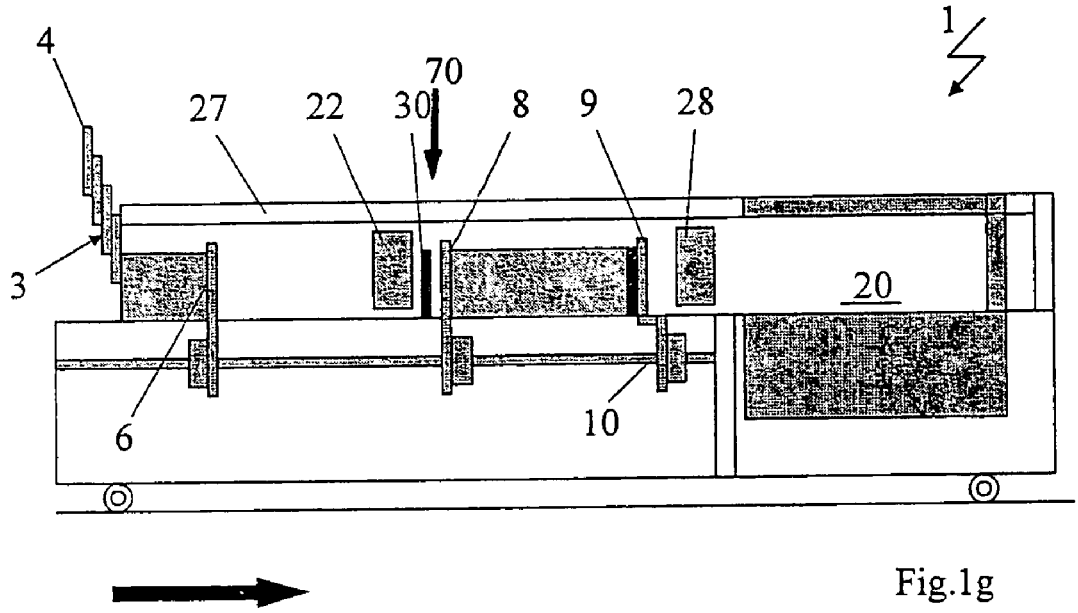
FIG. 1*g* is a schematic representation of the arrangement where a back end plate has been supplied between a compressing component of the compressing machine and a support element.

In FIG. 1*g*, the stack bundle 2 in the transfer position is located between the two compressing components 22, 28 of the compressing machine 19, and a back end plate 30 for reinforcing the back end of the stack bundle is supplied from an end-plate magazine 70 into a gap between the second support element 8 and the compressing component 22 (for acting on the back end of the stack bundle). The front and back end plates 29 and 30 can have the same dimensions.

Figure 1H:
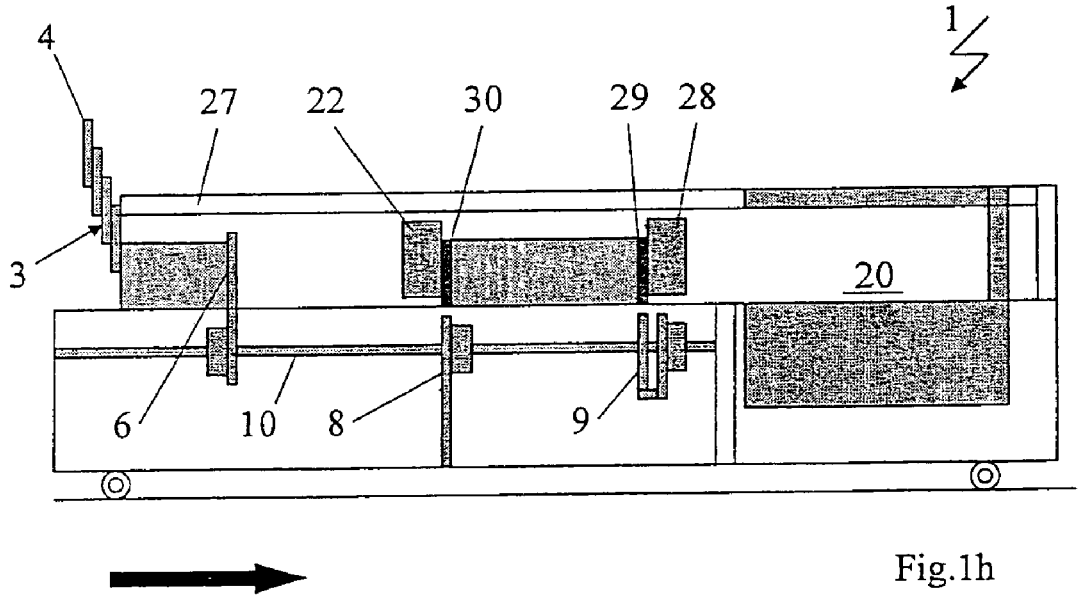
FIG. 1*h* is a schematic representation of the arrangement where the stack bundle is clamped between two end plates.

In FIG. 1*h*, the second and third support elements 8, 9 can be simultaneously removed so that the front end compressing component 28 and the back compressing component 22 can press against the front and back end plates 29, 30, which in turn press against the front and back ends of the stack bundle 2. Meanwhile, the stack formation resting on the first support element 6 continues to increase in length.

Figure 1I:
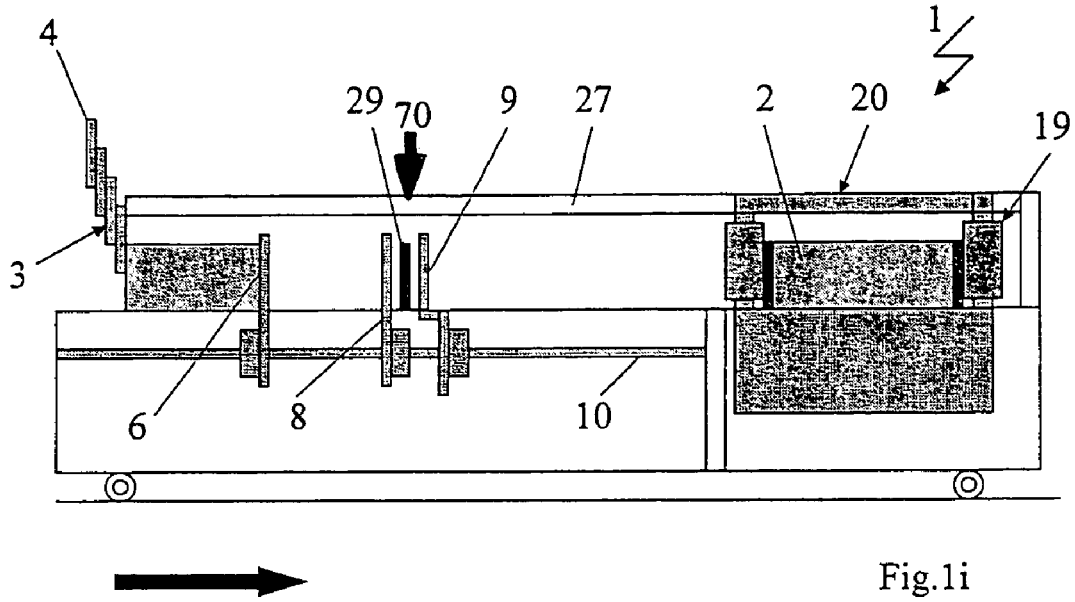
FIG. 1*i* is a schematic representation of the arrangement with the stack bundle located in a bundle strapping device and the supporting device taking over a front end plate.

In FIG. 1*i*, the second and third support elements 8, 9 have arrived at the end plate magazine 70 for taking over a front end plate 29. The stack bundle 2 has been gripped by the front and back compressing components 22, 28 and moved to the bundle strapping machine 20 along rails 27.

Figure 1J:
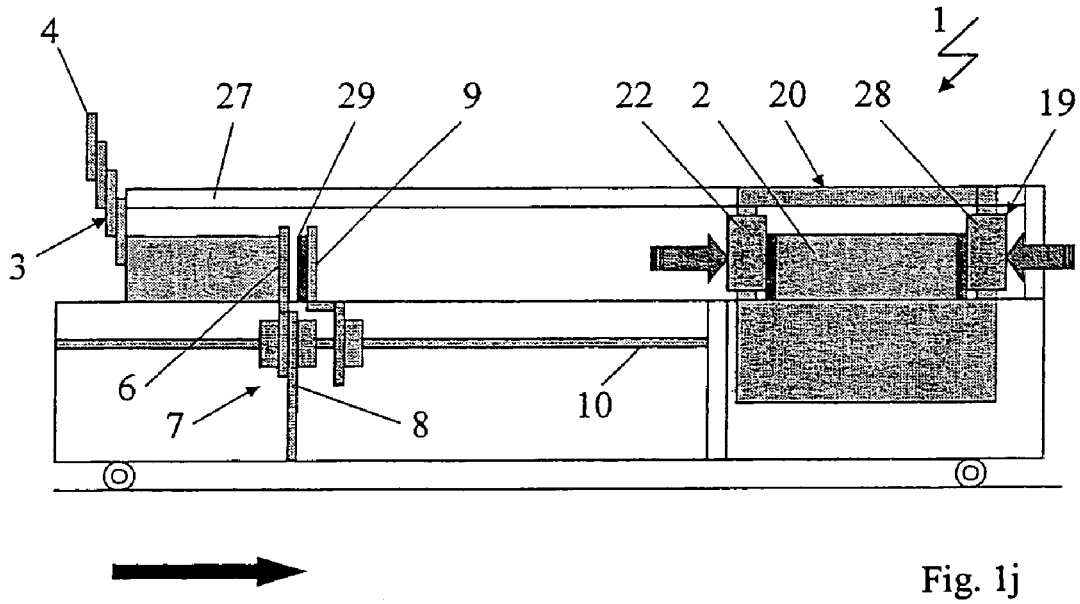
FIG. 1*j* is a schematic representation of the arrangement showing a start of a bundle strapping operation by the bundle strapping device and the front end plate moved closer to the front end of the stack.

In FIG. 1*j*, the front end plate 29 has moved to the front end of the continuously increasing stack, the stack bundle 2 in the strapping machine 20 is compressed for the last time and is subsequently strapped and/or tied together.

Figure 1K:
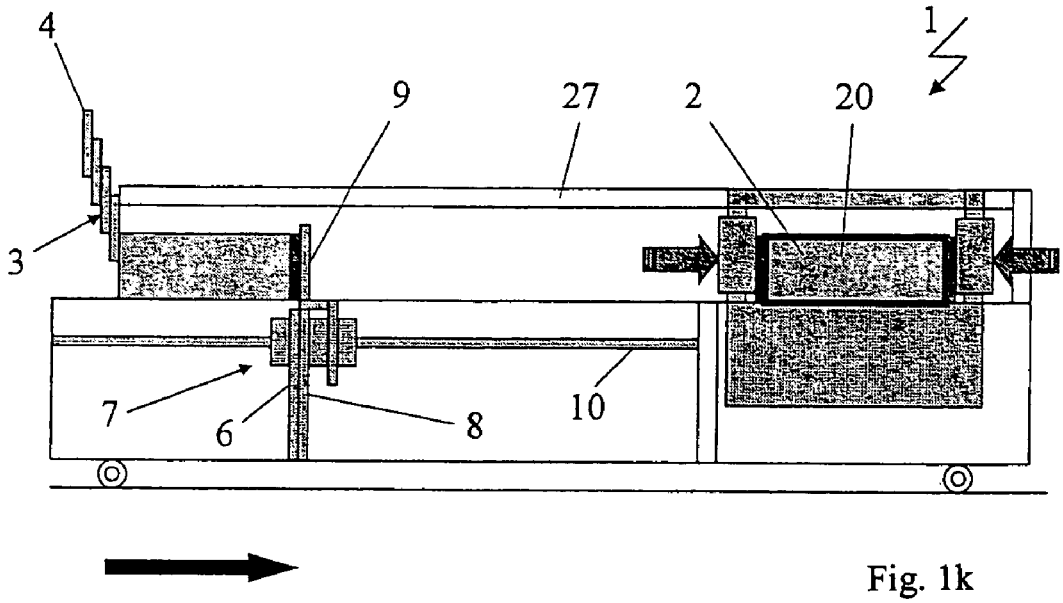
FIG. 1*k* is a schematic representation of the arrangement with the front end plate resting against the front end of the stack.
Figure 1L:
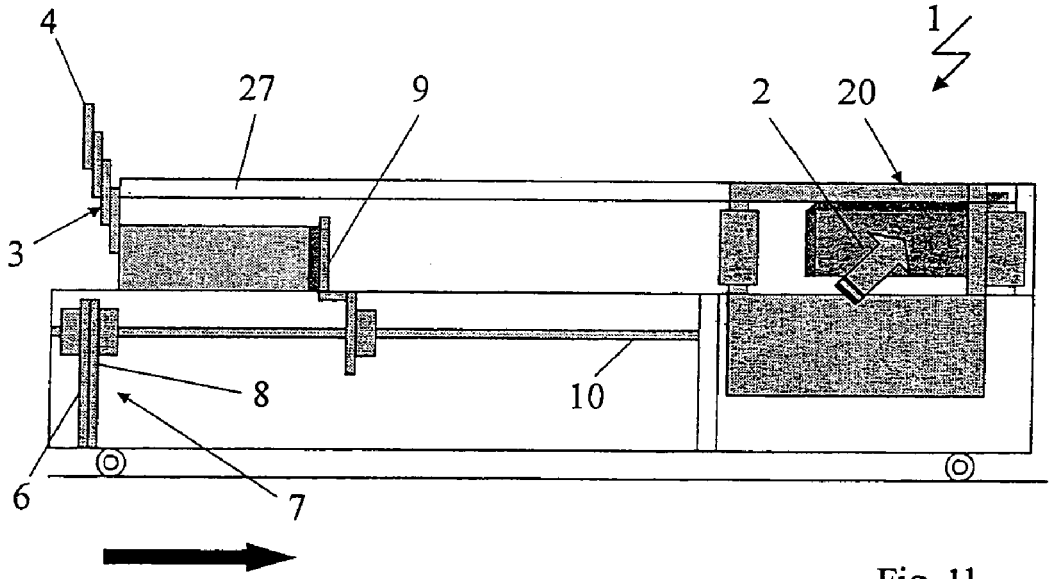
FIG. 1*l* is a schematic representation of the arrangement with the stack bundle being removed from the bundle strapping machine.

In FIG. 1*k*, the front end plate 29 rests against the front end of the stack and is supported by the third support element 9. The first and second support elements 6, 8 have been lowered to below the stack deposit support 5, and the strapping operation is completed.

In FIG. 11, the stack bundle 2 is removed from the strapping machine 20. The first and second support elements 6, 8 has returned to the starting position where a new stacking process has already started as also shown in FIG. 1*d*. The processing step in FIG. 11 is followed by the step shown in FIG. 1*f*. Thus, the stack bundling processes can be repeated continuously.

Figure 2:
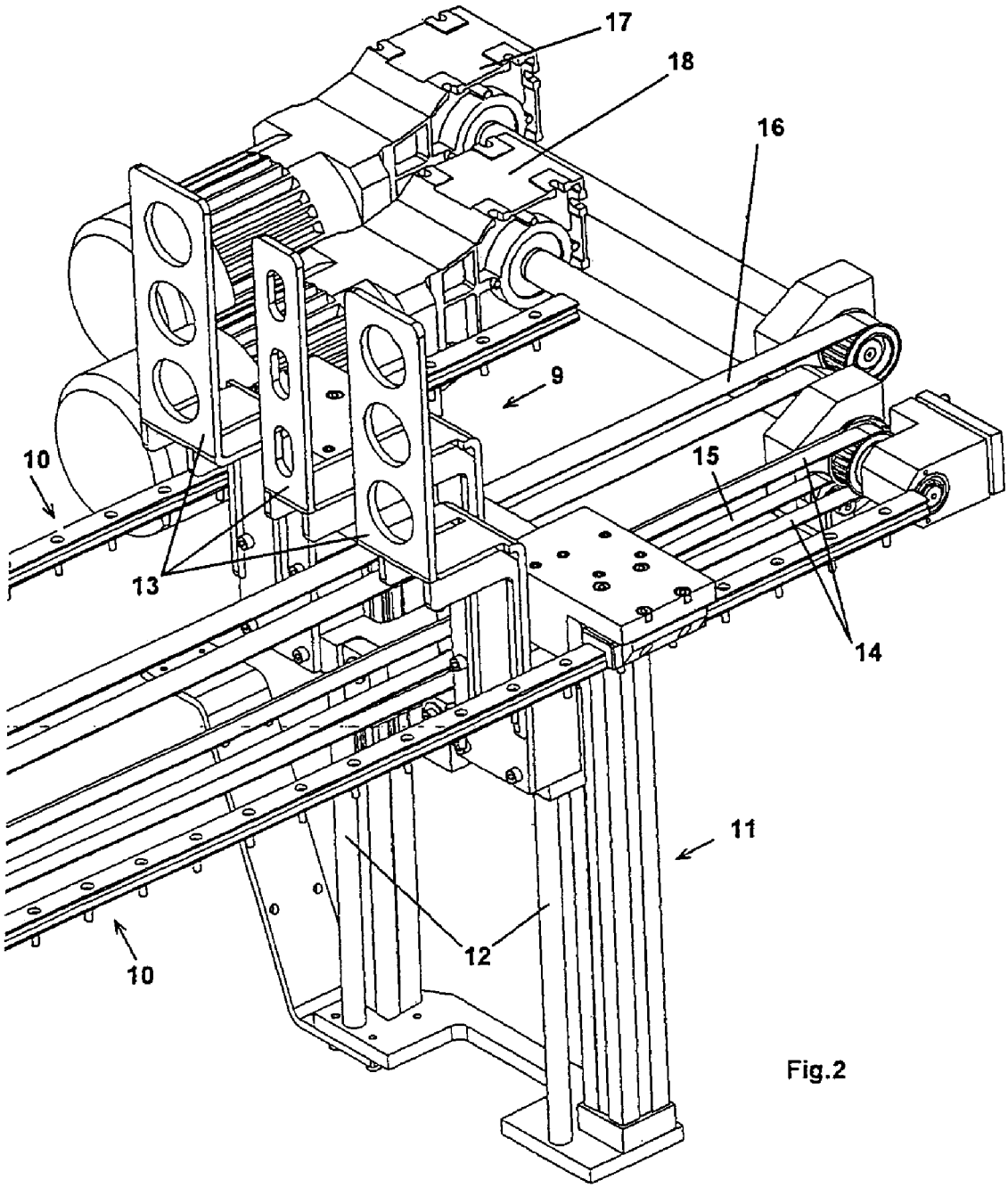
FIG. 2 is a three-dimensional representation of an exemplary embodiment of a drive arrangement for a supporting device according to the invention.

In FIG. 2, an exemplary embodiment of a traction means/drive for moving the multi-part supporting device 7 along the stack deposit support 5 is shown. As to the support elements of the supporting device 7, only the third support element 9 is depicted. The side guide 10 attached to a frame for the arrangement 1 and a traversing gear 11 for the third support element 9 are shown. The third support element 9 has three supporting plates 13 and can be lowered and raised on the traversing gear 11 with the aid of two stanchions 12 and a pneumatic cylinder (not shown). The third support element 9 can be driven by a toothed belt 14 along the stack deposit support 5, wherein the upper as well as the lower run of the toothed belt 14 are shown. The toothed belts 15 and 16 are provided for driving the first and second support elements 6 and 8, respectively. Each of the toothed belts 15–17 is wound around respective pulleys, one of which is connected to a drive motor. The gear motors 17 and 18 are assigned to the toothed belts 16 and 14, respectively. A drive motor for the toothed belt 15 can be located at an opposite end of the stack deposit support 5 in relation to the depicted end of the toothed belt 15. The first and second support elements 6, 8 can be mounted on traversing gears (not shown in FIG. 2) similar to the traversing gear 11 of the third support element 9 and moved up and down the respective traversing gears by a pneumatic cylinder in the same way that the third support element 9 moves up and down the traversing gear 11 with the aid of a pneumatic cylinder.

Figure 3:
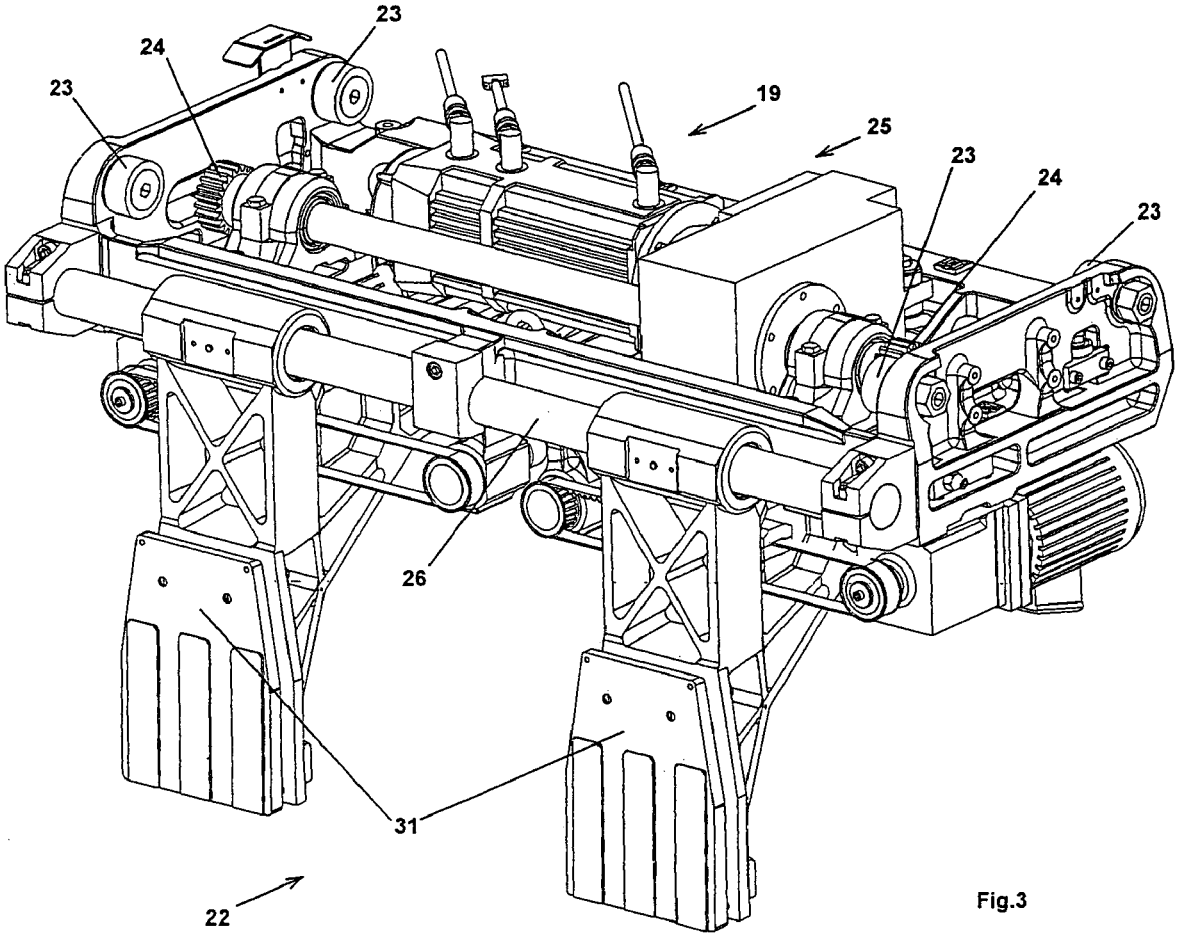
FIG. 3 is a three-dimensional representation of an exemplary support structure for a compressing component of a compressing machine according to the invention.

In FIG. 3, an exemplary embodiment of a support structure for a back end compressing component 22 of the compressing machine 19 is shown. The back end compressing component 22 has back end compressing plates 31, wherein the depicted side of the back end compressing plates 31 faces the movement direction of the stack bundles and can be arranged to press against the back end of a respective stack bundle. The back end compressing component 22, which together with the front end compressing component 28 forms the compressing machine/arrangement 19, is shown in its starting position in FIG. 1*a* and moves along the stack deposit support 5 in the movement direction of the stack bundles. The support structure for the back end compressing component 22 extends crosswise to the movement direction of the stack bundles and is arranged to move on its two rollers 23 on each side of the support structure along a stationary C-shaped rail (not shown). The rail 27 (see FIG. 1*a*) can be provided with a steering rack (not shown) on its bottom, and the steering rack can engage a gearwheel 24 of a traversing gear 25 for moving the support structure along the rail 27. The compressing plates 31 can be adjusted to a format of the signatures 4 by a guide rod 26, which is positioned above the compressing plates 31 and crosswise to the direction of the movement of stack bundles in the arrangement. The operating range for the compressing machine 19 (i.e., compressing and moving along the rail 27) extends from any point along the stack deposit support 5 to the end of the bundle strapping machine 20.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. An arrangement for producing stack bundles from signatures, comprising:

a horizontal stack deposit support;

a conveyor to supply a flow of signatures to the stack deposit support for formation of a signature stack having a front end and a back end; and a supporting device adapted to form a stack bundle having a front end and a back end, the supporting device comprising a first support element adapted to rise from below the stack deposit support and act on the front end of the stack, a second support element adapted to rise from below the stack deposit support and act on the back end of the stack bundle, and a third support element arranged to rise from below the stack deposit support in a first location to act on the front end of the stack and in a second location to act on the front end of the stack bundle.

2. The arrangement of claim 1, further comprising a compressing machine adapted to compress the stack bundle.

3. The arrangement of claim 2, wherein the second support element is adapted to act on the back end of the stack bundle and the third support element is adapted to act on the front end of the stack bundle to transport the stack bundle to the compressing machine.

4. The arrangement of claim 1, further comprising a bundle strapping machine adapted to strap the stack bundle.

5. The arrangement of claim 1, further comprising a separating device adapted to form a gap in the stack, wherein at least one of the first or second support elements can be raised into the gap.

6. An arrangement for producing stack bundles from signatures, comprising:

a horizontally extending stack deposit support;

a conveyor to continuously supply a scaled flow of the signatures to the horizontally extending stack deposit support for formation of a signature stack having a front end and a back end with respect to a direction of movement of the stack bundle through the arrangement;

a multi-part supporting device comprising first, second and third support elements, the supporting device being arranged to form a stack bundle by engaging the stack from below, the stack bundle having a front end and a back end with respect to a direction of a movement of the stack bundle through the arrangement;

the first support element being arranged to act on the front end of the stack and the second support element being arranged to act on the back end of the stack bundle, the first and second support elements arranged to be raised from below the stack deposit support to above the stack deposit support;

the third support element arranged to be raised in a first location to act on the front end of the stack and in a second location to act on the front end of the stack bundle;

a compressing machine, the supporting device being arranged to transfer the stack bundle to the compressing machine by moving the stack bundle from a waiting position to a transfer position along the stack deposit support; and a bundle strapping machine, the compressing machine being arranged to transfer the stack bundle to the bundle strapping machine.

7. The arrangement according to claim 6, wherein the third support element is arranged to move independently of the first and second support elements along the stack deposit support.

8. The arrangement according to claim 6, further comprising a separating device assigned to the first and the second support elements for forming a separating gap between the signatures supplied in the scaled flow, wherein the first and the second support elements can be raised jointly into the separating gap.

9. The arrangement according to claim 6, wherein the compressing machine includes:

first and second spaced apart compressing components to act on the front and back ends, respectively, of the stack bundle, the compressing machine being arranged to transport the stack bundle held between the first and second compressing components to the strapping machine, the strapping machine adjoining the stack deposit support and strapping the stack bundle with at least one band extending in the direction of the movement of the stack bundle through the arrangement.

10. The arrangement according to claim 9, further comprising an end-plate feeding mechanism, the end-plate feeding mechanism being arranged along the stack deposit support to supply end plates to reinforce the stack bundle at the front and back ends, respectively, the end-plate feeding mechanism being arranged to supply the back end plate at a gap between the second support element acting on the back end of the stack bundle at the transfer position and the second compressing component.

11. The arrangement according to claim 10, wherein the end-plate feeding mechanism is arranged along the stack deposit support at a location between the compressing components of the compressing machine when the stack bundle is in the transfer position.

12. The arrangement according to claim 6, further comprising a guide extending parallel to the stack deposit support, the first, second and third support elements of the supporting device being arranged to adjustably move on the guide.

13. The arrangement according to claim 12, further comprising rails arranged above and parallel to the stack deposit support, the compressing machine being arranged to move along the rails.

14. The arrangement according to claim 6, further comprising a gap formed between the second and third support elements along the stack deposit support, the second and third support elements transporting a front end plate for acting on the front end of the stack bundle held inside the gap in a direction opposite of the direction of the movement of the stack bundle through the arrangement.

15. A method of producing stack bundles from vertically aligned signatures in a row, utilizing the arrangement according to claim 6.

16. A method of producing stack bundles from continuously supplied signatures, utilizing the arrangement according to claim 6.

17. The arrangement according to claim 6, wherein the second and third support elements of the supporting device are arranged to act on the back end and the front end of the stack bundle, respectively, for moving the stack bundle to the transfer position.

18. The arrangement according to claim 17, further comprising a guide extending parallel to the stack deposit support, the second and third support elements of the supporting device being arranged to move along the guide.

19. The arrangement according to claim 17, further comprising an end-plate feeding mechanism, the end-plate feeding mechanism being arranged to supply a back end plate at a gap between the second support element and a compressing component of the compressing machine.

* * * * *